United States Patent [19]

Della Monica

[11] 4,090,301

[45] May 23, 1978

[54] GRAPHIC RECORDING SYSTEM

[76] Inventor: F. Peter Della Monica, 43 Riverview Ave., Danvers, Mass. 01923

[21] Appl. No.: 819,664

[22] Filed: Jul. 28, 1977

[51] Int. Cl.[2] ..... B43L 5/00; B43L 13/00

[52] U.S. Cl. ..... 33/76 R; 33/80

[58] Field of Search ..... 33/76 R, 80, 27 B; 35/31 E; 235/70 B

[56] References Cited

U.S. PATENT DOCUMENTS

| | | | |
|---|---|---|---|
| 1,624,280 | 4/1927 | Rasmusen | 33/76 R |
| 2,230,927 | 2/1941 | Bowman et al. | 33/80 |
| 3,047,954 | 8/1962 | Hislop | 33/76 R |
| 3,172,599 | 3/1965 | Passerini | 35/31 E |
| 3,363,319 | 1/1968 | Greer | 33/76 R |

*Primary Examiner*—Steven L. Stephan
*Attorney, Agent, or Firm*—John W. Ericson

[57] ABSTRACT

A graphic recorder for facilitating the preparation of records of functions of time, comprising a base on which a scale is mounted for movement along one coordinate axis relative to a markable scale on which a series of increments in a function of time to be recorded can be inscribed, a cursor is mounted on the scale for movement along a second coordinate axis relative to a preinscribed scale on which increments of time have been recorded, and a chart affixed to the base that is recorded with the scales and provided with indicia locating appropriate regions for marking significant domains in a field defined by indicial sequences inscribed in the scales on the chart aligned with the coordinate axes.

5 Claims, 7 Drawing Figures

GRAPHIC RECORDING SYSTEM

This invention relates to recording devices, and particularly to a novel graphing device especially suited for use by those unskilled in the mathematical arts. The device is of particular value to those seeking to maintain a regimen, either under medical supervision, or as a self-inforced discipline.

A significant weapon in the armory of the therapist is the compulsive tendency of a patient apt to be addicted to behavior patterns whose modification is the therapist's function and the patient's need. An example is the tendency toward obesity in persons who have no pathological reason for excursions from a diet that would maintain constant weight. In many instances, overindulgence results from a constant need for reassurance that could just as well be satisfied by self assurance that the individual is performing within accepted norms.

To continue with this example, it is not uncommon for overweight patients to be given a prescribed diet, of particular amounts of particular foods that may not always be available or affordable, or to be told that a certain rate of weight loss should be attained. The former is a prescription for experimentation and failure. The latter is not necessarily an available option even for those to whom a rate of change is a known concept, because it is not difficult to translate the loss of a pound overnight into 7 pounds a week while the individual gains 5 pounds in that week.

Many persons have considerable difficulty with the concept of a function, and particularly with the notion of a graphical representation of a function of one variable with respect to another. And even though a person may be quite capable of interpreting a properly presented graph, the task of preparing one may prove to be insuperable. The treachery of graphical displays is evidenced even among the sophisticated by the fact that suitable choices of scale functions and regions can distort meaningful relationships into nonsense, or vice versa. Thus, when an individual is instructed to keep a record of weight versus time (or temperature or blood pressure versus time, or temperature versus blood pressure, for that matter), several things may happen. The simplest is that the person may not know what a graph is. Secondly, there will very probably be an entirely inappropriate choice of the range of the variables over which the function is to be recorded. For example, a 200 pound patient who should weight 150 pounds may be asked to chart weight over a two-month period. The patient may not know what a chart is. Assuming a little more sophistication, the result may be a graph with time in days and weight in pounds. Or, time in weeks and weight in ounces. In either case, it is not likely the compulsive tendencies of the patient, causing undue weight increase in the first place, can be brought to bear the purposes of motivating weight losing behavior. The random changes that will be experienced with the choice of wrong ranges of the variables will in most instances prove discouraging.

The object of this invention is to facilitate the preparation of meaningful graphs by persons who are unskilled in the mathematical arts.

Briefly, the above and other objects of the invention are attained by the provision of a graphing device comprising a combination of elements usable in prescribed sequence so that the process of graphing is reduced to a series of steps, each simple, leading to a result which is comprehensible to the user. The device essentially consists of a plotting board on which a record sheet is mounted in position to be traversed by a cursor slidably mounted on a scale. The scale is in turn slidably mounted on the base for movement along an axis normal to the path of movement of the cursor. The record sheet is provided with orthogonal scales, on in prerecorded time increments, and the other in increments of the variable to be recorded. The latter is preferably in blank, so that appropriate increments can be inscribed by the user, or by the user's physician as may be appropriate. This feature enables the apparatus to be readily adapted to a wide variety of individual needs. The record sheet is marked with indicia, in the form of regions such as circles, ovals, diamonds, squares or dots, at appropriate intervals to record significant changes in the variable corresponding to particular marked coordinates on the orthogonal scales on the record sheet. This device avoids the tendency of the user to make a more favorable approximation than is justified, and in fact avoids the need to extrapolate or interpolate entirely.

On the slidable scale there are preferably two parallel rows of indicia, corresponding to the time scale on the record sheet . One of these may be used in combination with a suitably formed aperture in the cursor to mark off the time segments as the record is filled in. This device has a particular advantage, in that the time scale can be marked in simple numerical sequence from an arbitrary starting date, so that no particular calendar need be associated with the device. The second scale is helpful in lining up the coordinates and in preserving a visual record of the time increments that have elapsed. The two together are useful, because they make practical the desirable use of a cantilever mounting of the scale on the base so that inherent flexibility of this type of mounting does not interfere with the accuracy with which the scale can be positioned.

The cursor is preferably provided with at least two additional apertures, one of which is adapted to register with the ordinate scale on the record sheet, and thus facilitate an initial location of the slide on the ordinate scale, and a second which facilitates the introduction of a pencil to mark the appropriate preselected region on the record sheet once the proper place has been located on the upper scale on the movable scale. A desirable additional feature is the provision of an auxiliary window in the free end of the scale cooperating with a second ordinate scale on the record sheet on which progress can be recorded in terms of a desired progression in the independent variable, such as weight, or a rate of change noted if the variable is a monitored function such as temperature, blood pressure, or the like. It will be apparent as the description proceeds that this arrangement of elements results in a very simply manipulable device that is susceptable of use in a readily learned repetitive manner especially conducive to use by those who have no particular skill in the mathematical arts, or who are particularly responsive to repetitive acts in support of self-discipline.

The apparatus of the invention, and its mode of operation, will best be understood in the light of the following detailed description, together with the accompanying drawings, illustrative of a presently preferred embodiment of the invention.

Figure 1:
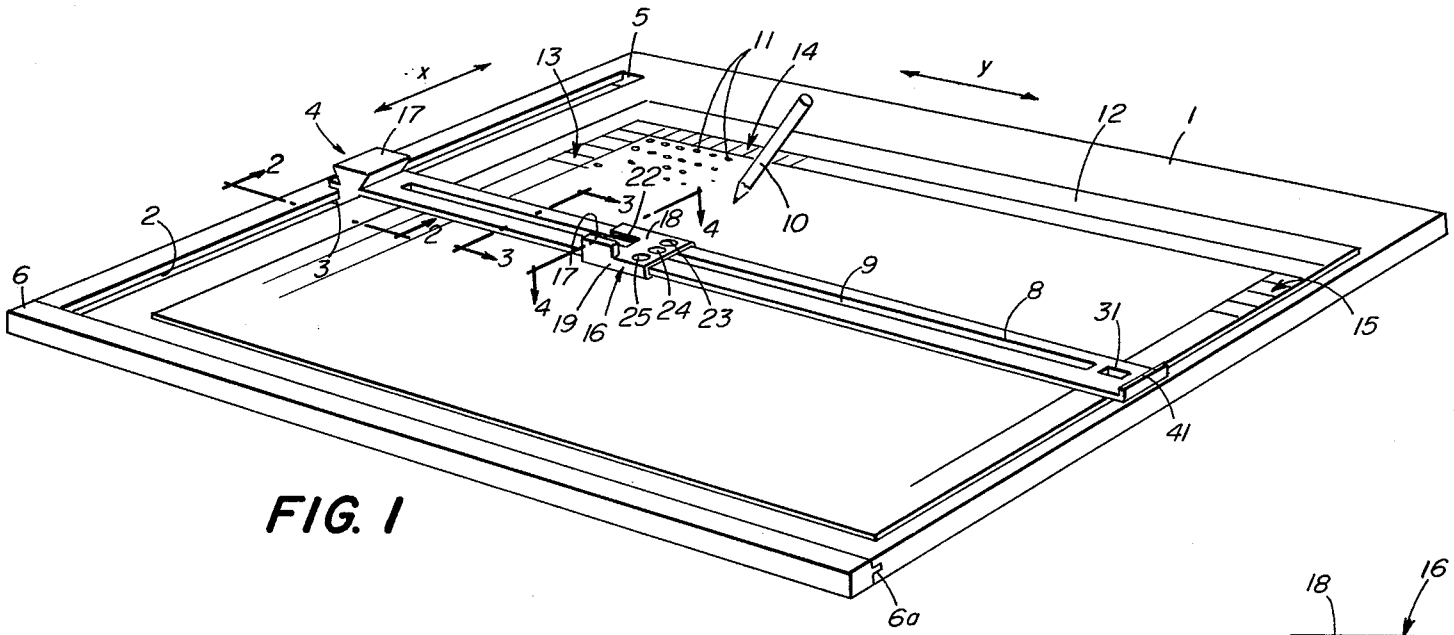
FIG. 1 is a schematic perspective sketch of a graphing device in accordance with the invention, shown in association with a marking device.
Figure 2:
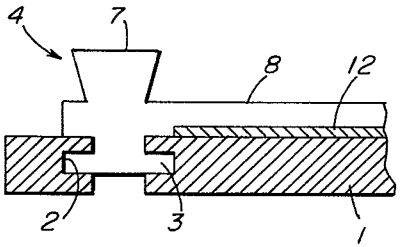
FIG. 2 is a fragmentary cross-sectional elevational schematic sketch, on an enlarged scale, taken essentially along the lines 2—2 in FIG. 1.

Referring to FIG. 1, the apparatus of the invention comprises a base 1 of wood, metal, plastic or the like, but preferably of a homogeneous and readily machined or molded thermoplastic or thermosetting synthetic resin such as poly (methyl methacrylate), phenol-formaldedyde resin or the like. The base 1 is milled or molded with a dovetail slot 2, as best seen in FIG. 2, adapted to receive a corresponding tongue comprising lugs 3 formed on a slide generally designated 4. The slide 4 is adapted to move along an ordinate axis identified as X in FIG. 1 within bounds prescribed by an end 5 of the slot 2 and a stop 6 inlet into the base 1 as suggested at 6*a*, and there secured by a suitable cement, adhesive, bolts or the like, not shown. The slide 4 and the stop 6 may be made of any suitable materials, but are preferably of the same material as the base 1.

Figure 3:
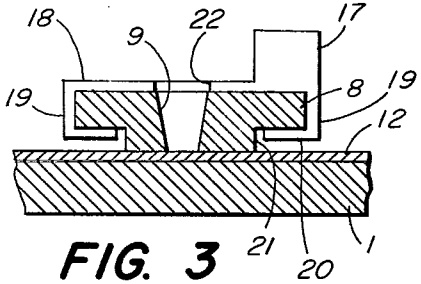
FIG. 3 is a fragmentary cross-sectional elevational schematic sketch, on an enlarged scale, taken essentially along the lines 3—3 in FIG. 1.

Formed integral with the slide 4 are a handle 7, adapted to manipulate the slide, and a cantilevered scale 8 that extends normal to the direction of the slot 2. The scale 8 is provided with a longitudinal slot 9 that is preferably tapered, as best shown in FIG. 3, to admit and guide a marking implement, such as a pencil, pen, or the like, suggested at 10 in FIG. 1, into registry with a prerecorded region such as 11 inscribed on a record sheet 12 that is temporarily or permanently secured to the base 1. The slide 4 terminates in a stop 41 to limit the movement of a cursor 16, to be described.

The record sheet 12 may be of paper, plastic or the like, but is preferably of paper comprising one or more sheets of a pad attached to the base 1 by a conventional pressure sensitive adhesive, double-faced pressure sensitive tape, cement, or the like, in the form of a pad of similar sheets, or as a single sheet as desired.

Figure 6:
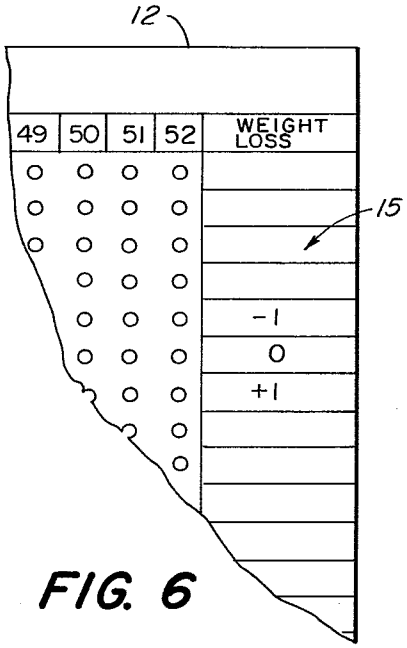
FIG. 6 is a fragmentary schematic plan view, on an enlarged scale, showing the upper right hand corner of the record sheet in FIG. 1 in more detail.
Figure 5:
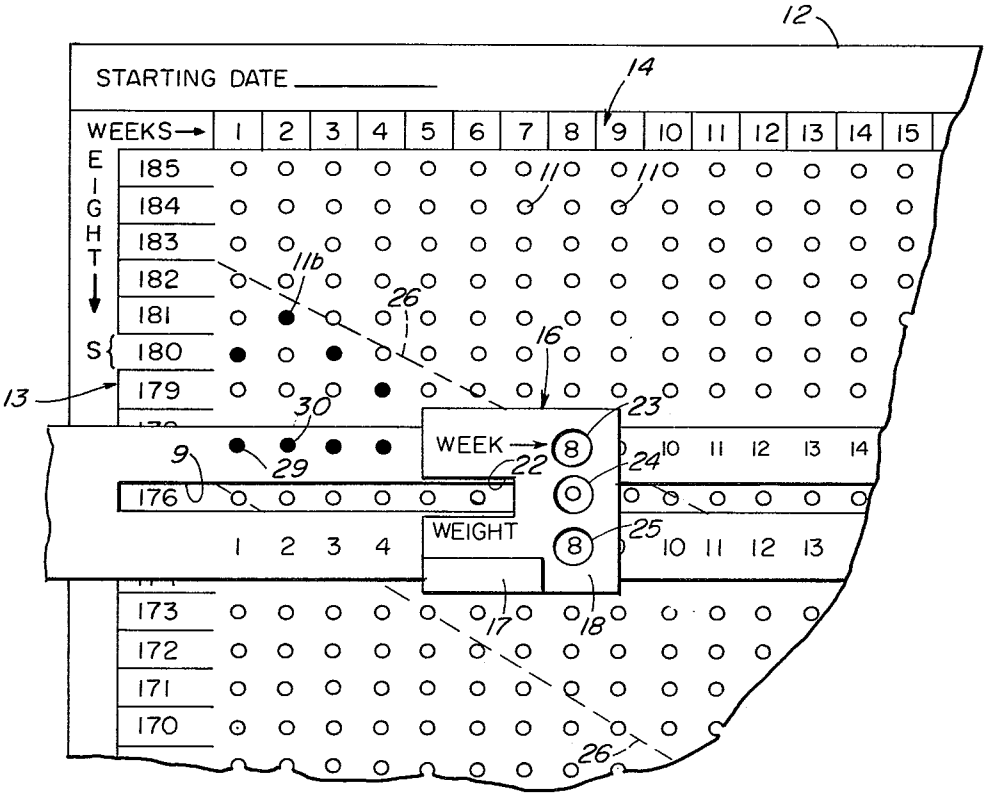
FIG. 5 is a fragmentary schematic plan view, on an enlarged scale, showing the upper left hand corner of a record sheet, a portion of the slide, and the cursor of the apparatus of FIG. 1 in more detail.

The record sheet 12 is preferably marked with an ordinate scale 13, shown schematically in FIG. 1 and more particularly in an illustrative embodiment in FIGS. 5 and 6, in which lines marking predetermined regions are inscribed so that appropriate numbers, representing weights, temperatures, or the like, can be entered in appropriate increments to serve the purposes of the user. One of these regions, inscribed with indicia such as the S in FIG. 5, designates the starting point. For a dieting regimen designed to record weight loss, the region S would preferably be located toward the upper end of the scale 13, though the place it at the very top would probably be self-defeating, because any excursions off-scale could be unduly discouraging to the user. For a weight gaining program, such as a controlled weight gain during pregnancy, for example, the starting point S would preferably be located toward the bottom of the chart. Where a constant value of a desired variable such as weight is the desired goal, it might be most appropriate to start in the middle of the scale.

An abscissa scale 14, shown schematically in FIG. 1 and in more detail in FIG. 5, is preferably preinscribed with indicia signifying increments of time, such as the numbers from 1 to 52 shown in illustrative part in FIG. 5. The time increments may represent weeks, and the illustrative embodiment is adapted for a one year program in weeks. However, the system is equally adapted for use in hours, days or months. The particular advantage of the scale is that it is independent of clock time or calendar time; in other words, "week 1", or "day 1", can be any week or day in the year or month, or "hour 1" can be any time of the day. The potential disadvantage, that the user may not remember whether it is the eighth week or the tenth week, for example, is overcome by other means to be described.

A scale generally designated 15 in FIG. 6 is preinscribed in regions adapted to be filled in with loss or gain values, shown as running in a negative sequence upward from a zero on the starting line S and in a positive sequence downward from the starting line in the weight loss program of the illustrative embodiment. The use of the scale 15 will be described below.

On the variable scale 8 is slidably mounted a cursor 16, shown in FIGS. 1, 3, 4, and 5, which may be of any suitable material such as sheet metal or the like, or may be of the same material as the scale 8. The cursor 16 is preferably formed integral with an upstanding ear 17 to serve as a handle for moving the cursor along the scale 8.

The cursor 16 further comprises an upper panel 18 formed integral with the ear 17 and downwardly extending side walls 19. The side walls 19 are in turn formed integrally with inwardly extending flanges 20, as best shown in FIG. 3, that receive the edges of the scale 8. A central rib 21 is formed integral with the scale 8 to engage the record sheet 12 and support the cursor 16 in a position slightly above the record sheet 12 so that the cursor can be moved along the scale 8 without frictional engagement with the record sheet.

The upper wall 18 of the cursor 16 is formed with a rectangular window in the form of a slot 22, which may be filled with a cylindrical magnifying lens of plastic or the like, not shown. The window formed by the slot 22 is adapted to expose a different one of the regions on the scale 13 in each of a set of adjusted positions of the scale 8, when the cursor 16 is in an extreme position to the left as seen in FIGS. 1 and 5. As suggested in FIG. 5, a legend such as "WEIGHT" is preferably inscribed adjacent the window 22 to indicate its function.

Figure 4:
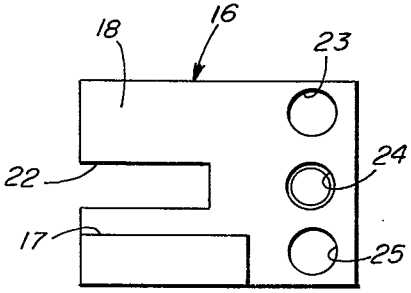
FIG. 4 is a schematic plan view, on an enlarged scale, of a cursor forming a part of the apparatus of FIG. 1, taken essentially along the lines 4—4 in FIG. 1.

As shown in FIGS. 1, 4, and 5, the upper wall 18 of the cursor 16 is formed with three circular apertures 23, 24, and 25 in vertical registry. The outer apertures 23 and 25 are adapted to cooperate with upper and lower rows of indicia marked on the scale 8 and corresponding to and in registry with the indicia on the scale 14 on the record sheet 12, so that when the cursor 16 is in position in registry with an appropriate time value, such as week 8 on scale 14 in FIG. 5, this fact can be observed through the windows 23 and 25 and any angular error in the position of the scale 8 relative to parallelism with the *y* axis can be observed and corrected.

The central aperture 24 in the cursor 16 is preferably tapered to match the taper in the slot 9 in the scale 8, as suggested in FIGS. 3 and 5, to guide the marking implement 10, shown in FIG. 1, into correspondence with one of the regions 11 on the record sheet 12 when the windows 23 and 25 indicate proper registry with a chosen time value on the scale 14.

Operation of the apparatus of the invention will next be described, with particular reference to FIGS. 1, 5, and 6, and to the particular illustrative embodiment depicted therein. Assume that a weight loss rate of about one pound per week has been selected, or prescribed, for an individual whose ideal weight is 149 pounds and whose actual weight is 180 pounds. The number 180 is now inscribed in the S region on the scale 13, and the rest of the regions filled in above and below in appropriate increments, here illustrated as one pound increments suited to the desired rate of change in pounds per week. In other words, the increments in the dependent variable should be selected in terms of the increments of the independent variable so that the desired rate of change will be expressible as an integer when it is maintained. Thus, if the desired rate of increase or decrease was five pounds per week, it would be preferred to record weight to the nearest 5 pounds; or, if it were ¼ pounds per week, to the nearest ¼ pound, so that the concept of a constant rate of change would not be complicated by arithmetical complexities. Of course, if five pound increments were of interest, the time scale might be more appropriately expressed in months; on the other hand, ¼ pound increments would be more appropriate for use with a time scale in days. These choices are most appropriately made by the individual's physician.

Figure 7:
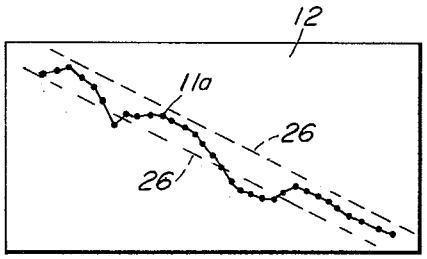
FIG. 7 is a schematic plan view of a completed record sheet produced in accordance with the invention.

Having inscribed the scale 13 with the appropriate numerical indicia, which can be accomplished once the user's initial weight is determined and a weight loss, gain or maintenance regimen prescribed, a pair of dotted boundary lines 26, indicated in FIGS. 5 and 7, marking appropriate bounds around the desired trend line may be inscribed at the physician's discretion. It should be advised that if the user's weight pattern is within the dotted lines 26, there should be no concern, and they shold be located accordingly. The locations shown are merely illustrative, and would vary from individual to individual. Excursions beyond the bounds of the dotted lines should be intepreted as a signal that the diet is not being maintained as intended, either by overindulgence, or by too severe a diet.

When the record sheet 12 has been prepared as just described, the user is instructed to bring the slot 9 in the scale 8 into registry with the starting region S on the scale 13, reading 180 pounds, and then to bring the window 22 on the cursor 16 into registry with the 180 pound reading with the cursor at the left end of the scale 8. Next, the marking implement 10 is placed into the aperture 24 in the cursor 16, and the first region 11 at the coordinates week 1, weight 180 = S, is marked over as shown at 11*a* in FIG. 5. Just before or after this is done, the marker 10 is inserted in the aperture 23 in the cursor 16 to obliterate the first indicia (1) in the upper series on the scale 8, as suggested at 29 in FIG. 5, to signify that the first week has been recorded.

At the appropriate time during the second week of the program, preferably at the same time during the same day of the week as the first time, the user's weight is determined. The cursor 16 is placed at the extreme position to the left in the slide 8. The slide 8 is then moved until the new weight is observed in the slot 9 on the scale 13 through the slot 22 in the cursor 16. The cursor 16 is now moved to the right on the slide 8 until the next unobliterated region on the upper scale on the slide 8, corresponding to week 2, is observed through the aperture 23.

The apparatus is now in position to fill in the appropriate region 11 at the intersection of the second week with the measured weight, for example, 181 pounds, and this region is marked out with the marker 10 through the aperture 24 as indicated at 11*b*. The number 2 visible through the aperture 23 on the scale 8 is also filled in at this time, as indicated at 30 in FIG. 5.

Use of the apparatus in the manner just described is continued in the manner just described, producing in due course a series of filled in regions 11 that may be connected by straight line segments to form a graph of the kind suggested in FIG. 7. As illustrated in FIGS. 5 and 7, the trend may be up or down for any given interval. If desired, the net gain or loss may be recorded on the scale 15, shown in FIGS. 1 and 6, starting from a zero on the starting line. The scale 15 may be inspected and filled in at any adjusted position of the scale 8 through a window 31 formed in the right hand side of the scale 8 as shown in FIG. 1.

While the invention has been described with respect to the details of illustrative embodiments thereof, many changes and variations will occur to those skilled in the art upon reading this description. Such can obviously be made without departing from the scope of the invention.

Having thus described the invention, what I claim is:

1. A recording device for enabling a user unskilled in the mathematical arts to prepare a graph of a function of time, comprising a base, means forming a first elongated slot in said base extending along a first coordinate axis, a slide having a second slot, means formed on one end of said slide and engaging said first slot for cantilever mounting of said slide for movement on said base aong said first coordinate axis a scale on said slide, said scale extending normal to said first axis, a cursor, means slidably mounting said cursor on said slide for movement therealong in directions normal to said first axis, a record sheet mounted on said base and formed with indicia comprising a blank scale and a preinscribed scale running along orthogonal axes one of which is parallel with said first axis, said preinscribed scale being formed with perceptible indicia in uniform increments of an independent variable, said blank scale being formed with perceptible indicia indicating regions adapted to be marked with a scale of values of a dependent variable, means forming perceptible coordinate indicia denoting regions on said record sheet at each intersection along a line parallel with one of said orthogonal axes through a value on said preinscribed scale with a line parallel to the other of said orthogonal axes through a region on said blank scale, means forming a first aperture in said cursor adapted to admit a marking implement through said second slot into marking engagement with said record sheet, means forming at least a second aperture in said cursor in a line with said first aperture in said cursor that is parallel to said first axis, means forming perceptible indicia on said slide in rows normal to said first axis and parallel to a first of said orthogonal scales on said record sheet to facilitate alignment of said cursor with said first scale, and means forming another aperture serving as a window in said cursor adapted to be aligned with a desired location on the other of said orthogonal scales in one extreme position of said cursor on said slide.

2. A recording device for enabling a user unskilled in the mathematical arts to prepare a graph of a function of time, comprising a base, a slide, means mounting said slide for movement on said base along a first coordinate axis, said slide extending normal to said first axis, a cursor, means slidably mounting said cursor on said slide for movement therealong in directions normal to said first axis, a record sheet mounted on said base and formed with indicia comprising a blank scale and a preinscribed scale running along orthogonal axes one of which is parallel with said first axis, said preinscribed scale being formed with perceptible indicia in uniform increments of an independent variable, said blank scale being formed with perceptible indica indicating regions adapted to be marked with a scale of values of a dependent variable, means forming perceptible coordinate indicia denoting regions on said record sheet at each intersection along a line parallel with one of said orthogonal axes through a value on said preinscribed scale with a line parallel to the other of said orthogonal axes through a region on said blank scale, means forming an elongated slot in said slide through which a marking implement can be inserted into marking engagement with said record sheet, said slot running normal to said first axis in position to expose a different row of said coordinate indicia in each of a set of different positions of said slide relative to said base, means forming a first aperture in said cursor adapted to register with said slot and admit a marking implement through said slot into marking engagement with said record sheet, means forming perceptible indicia on said slide in rows normal to said first axis and parallel to a first of said orthogonal scales on said record sheet to facilitate alignment of said cursor with said first scale, and means forming a second aperture serving as a window in said cursor adapted to be aligned with a desired location on the other of said orthogonal scales in one extreme position of said cursor on said slide.

3. A recording device for enabling a user unskilled in the mathematical arts to prepare a graph of a function of time, comprising a base, a slide, means mounting and slide for movement on said base along a first coordinate axis, said slide extending normal to said first axis, a cursor, means slidably mounting said cursor on said slide for movement therealong in directions normal to said first axis, a record sheet mounted on said base and formed with indicia comprising a blank scale and a preinscribed scale running along orthogonal axes one of which is parallel with said first axis, said preinscribed scale being formed with perceptible indicia in uniform increments of an independent variable, said blank scale being formed with perceptible indicia indicating regions adapted to be marked with a scale of values of a dependent variable, means forming perceptible coordinate indicia denoting regions on said record sheet at each intersection along a line parallel with one of said orthogonal axes through a value on said preinscribed scale with a line parallel to the other of said orthogonal axes through a region on said blank scale, means forming an elongated slot in said slide through which a marking implement can be inserted into marking engagement with said record sheet, said slot running normal to said first axis in position to expose a different row of said coordinate indicia in each of a set of different positions of said slide relative to said base, means forming a first aperture in said cursor adapted to register with said slot and admit a marking implement through said slot into marking engagement with said record sheet, means forming a second aperture in said cursor in a line with said first aperture in said cursor that is parallel to said first axis, means forming perceptible indicia on said slide in a row normal to said first axis and parallel to a first of said orthogonal scales on said record sheet to facilitate alignment of said cursor with said first scale, and means forming another aperture serving as a window in said cursor adapted to be aligned with a desired location on the other of said orthogonal scales in one extreme position of said cursor on said slide.

4. A recording device for enabling a user unskilled in the mathematical arts to prepare a graph of a function of time, comprising a base, a slide, means mounting said slide for movement on said base along a first coordinate axis, said slide extending normal to said first axis, a cursor, means slidably mounting said cursor on said slide for movement therealong in directions normal to said first axis, a record sheet mounted on said base and formed with indicia comprising a blank scale and a preinscribed scale running along orthogonal axes one of which is parallel with said first axis, said preinscribed scale being formed with perceptible indicia in uniform increments of an independent variable, said blank scale being formed with perceptible indicia indicating regions adapted to be marked with a scale of values of a dependent variable, one said region being associated with perceptible indicia indicating a starting region in which a first value of said dependent variable is to be inscribed corresponding with a first value of the independent variable on said preinscribed scale, means forming perceptible coordinate indicia denoting regions on said record sheet at each intersection along a line parallel with one of said orthogonal axes through a value on said preinscribed scale with a line parallel to the other of said orthogonal axes through a region on said blank scale, means forming an elongated slot in said slide through which a marking implement can be inserted into marking engagement with said record sheet, said slot running normal to said first axis in position to expose a different row of said coordinate indicia in each of a set of different positions of said slide relative to said base, means forming a first aperture in said cursor adapted to register with said slot and admit a marking implement through said slot into marking engagement with said record sheet, means forming second and third apertures in said cursor in a line with said first aperture in said cursor that is parallel to said first axis, means forming perceptible indicia on said slide in rows normal to said first axis and parallel to a first of said orthogonal scales on said record sheet to facilitate alignment of said cursor with said first scale, and means forming another aperture serving as a window in said cursor adapted to be aligned with a desired location on the other of said orthogonal scales in one extreme position of said cursor on said slide.

5. A recording device for enabling a user unskilled in the mathematical arts to prepare a graph of a function of time, comprising a base, means forming a dovetail slot in said base extending along a first coordinate axis, a slide, means forming a tongue on said slide at one end thereof received in said slot for cantilever mounting of said slide for movement on said base along said first coordinate axis, said slide extending normal to said first axis, a cursor, means slidably mounting said cursor on said slide for movement therealong in directions normal to said first axis, a record sheet mounted on said base and formed with indicia comprising a blank scale and a preinscribed scale running along orthogonal axes one of which is parallel with said first axis, said preinscribed scale being formed with perceptible indicia in uniform increments of an independent variable, said blank scale being formed with perceptible indicia indicating regions adapted to be marked with a scale of values of a dependent variable, one said region being associated with perceptible indicia indicating a starting region in which a first value of said dependent variable is to be inscribed corresponding with a first value of the independent variable on said preinscribed scale, means forming perceptible coordinate indicia denoting regions on said record sheet at each intersection along a line parallel with one of said orthogonal axes through a value on said preinscribed scale with a line parallel to the other of said orthogonal axes through a region on said blank scale, means forming an elongated slot in said slide through which a marking implement can be inserted into marking engagement with said record sheet, said slot of said slide running normal to said first axis in position to expose a different row of said coordinate indicia in each of a set of different positions of said slide relative to said base, means forming a first aperture in said cursor adapted to register with said slot of said slide and admit a marking implement through said slot of said slide into marking engagement with said record sheet, means forming second and third apertures in said cursor in a line with said first aperture in said cursor that is parallel to said first axis, means forming perceptible indicia on said slide in rows normal to said first axis and parallel to a first of said orthogonal scales on said record sheet to facilitate alignment of said cursor with said first scale, and means forming another aperture serving as a window in said cursor adapted to be aligned with a desired location on the other of said orthogonal scales in one extreme position of said cursor on said slide.

* * * * *